US012202704B1

(12) United States Patent
Ferrari et al.

(10) Patent No.: US 12,202,704 B1
(45) Date of Patent: Jan. 21, 2025

(54) SPOOL AND BOBBIN STORAGE AND LABELING DISC

(71) Applicants: Michael C. Ferrari, Hudson, NY (US); Michael A. Ferrari, Kinderhook, NY (US); Caesar M. Ferrari, Kinderhook, NY (US)

(72) Inventors: Michael C. Ferrari, Hudson, NY (US); Michael A. Ferrari, Kinderhook, NY (US); Caesar M. Ferrari, Kinderhook, NY (US)

( * ) Notice: Subject to any disclaimer, the term of this patent is extended or adjusted under 35 U.S.C. 154(b) by 0 days.

(21) Appl. No.: 18/608,623

(22) Filed: Mar. 18, 2024

(51) Int. Cl.
*B65H 75/18* (2006.01)
*B65H 75/22* (2006.01)

(52) U.S. Cl.
CPC ..... *B65H 75/182* (2013.01); *B65H 75/2254* (2021.05)

(58) Field of Classification Search
CPC ..... B65H 75/182; B65H 75/2254
USPC ..... 40/309; 242/609.3
See application file for complete search history.

(56) References Cited

U.S. PATENT DOCUMENTS 808,114 A * 12/1905 Rowley et al. ..... B65H 75/28 40/309
833,174 A * 10/1906 Palmer ..... B65H 75/14 242/118
1,825,567 A 9/1931 Woodruff
1,858,410 A * 5/1932 Morey ..... B65H 75/182 40/309
1,865,908 A * 7/1932 Hengst ..... G09F 3/206 24/378.1
2,002,609 A * 5/1935 Mygland ..... D05B 57/28 40/309
2,200,720 A * 5/1940 Morin ..... B65H 75/182 15/105
2,851,801 A * 9/1958 Jennings ..... G11B 23/037 40/309
2,859,547 A * 11/1958 Davidson ..... G09F 3/00 40/309
3,430,886 A 3/1969 Sweeney
3,724,771 A * 4/1973 Zielke ..... B65H 20/26 242/608.5
4,702,373 A * 10/1987 Meade ..... G11B 23/027
(Continued)

FOREIGN PATENT DOCUMENTS

FR 2 743793 * 7/1997

*Primary Examiner* — William A. Rivera
(74) *Attorney, Agent, or Firm* — Heslin Rothenberg Farley & Mesiti P.C.

(57) ABSTRACT

A bobbin insert includes a head, a stem extending from the head, and an attachment member connected to the stem. A system for storing or labeling a bobbin includes a bobbin having a first opening on a first end of the bobbin and a second opening on a second end of the bobbin opposite the first end. The bobbin further includes a through-hole extending from the first opening to the second opening. The system further includes an insert having a head, a stem extending from the head, and an attachment member connected to the stem. The stem is configured to be inserted into the through-hole through the first opening, and at least a portion of the attachment member is configured to extend out of the second opening. A method for storing or labeling a bobbin includes inserting a stem of an insert into a through-hole of the bobbin.

19 Claims, 14 Drawing Sheets

(56) References Cited

U.S. PATENT DOCUMENTS

| | | | | |
|---|---|---|---|---|
| 6,385,879 | B1 * | 5/2002 | Fisher | B65C 7/00 40/309 |
| 6,857,595 | B1 * | 2/2005 | Schaefer | B65H 75/2272 242/608.5 |
| 11,584,559 | B1 | 2/2023 | Bigbee, Jr. et al. | |
| 2003/0006336 | A1 * | 1/2003 | Myers, Jr. | G09F 23/10 242/600 |
| 2016/0229660 | A1 | 8/2016 | Ronnie | |

* cited by examiner

SPOOL AND BOBBIN STORAGE AND LABELING DISC

TECHNICAL FIELD

The present disclosure generally relates to storage and labeling. More particularly, but not exclusively, the present disclosure relates to storing and labeling of spools or bobbins holding jewelry wire.

BACKGROUND

In the jewelry making industry, among others, materials such as metal wire is typically wound around a spool or bobbin. The materials are stored around the spool or bobbin until needed. The materials may then be taken from the spool or bobbin to be used in manufacturing, such as when making various pieces of jewelry. It is not uncommon for there to be numerous different kinds of materials, each wound around a spool or bobbin and labeled such that an observer can ascertain the type of material merely by viewing the external label affixed to the spool or bobbin.

External labels may be especially helpful where the type and size of the material wound around a particular spool or bobbin is not readily visible (e.g., when using a kumihimo bobbin), or otherwise not easily identified by sight alone. However, the oils found on human fingers and other materials used in the jewelry making process may cause the labels to deteriorate over time as spools or bobbins are used, obscuring the labels and thus the type and size of the materials indicated thereon, and increasing the time and effort required to locate necessary or desired materials for a particular project. Spools or bobbins may also be easily displaced, or may become unorganized when a system for storing and labeling the spools or bobbins, or the materials thereon, has not been properly employed.

Thus, a need exists for labeling solutions for spools and bobbins which do not wear off over time, and for storage solutions which are adaptable over time to different workflows or changes thereto.

SUMMARY OF THE INVENTION

In accordance with the above, it is an object of the present disclosure to provide devices, systems and methods for labeling and/or storing spools and bobbins.

The present disclosure provides, in a first aspect, a bobbin insert including a head, a stem extending from the head, and an attachment member connected to the stem.

The present disclosure provides, in a second aspect, a system for storing or labeling a bobbin. The system may include a bobbin having a first opening on a first end of the bobbin and a second opening on a second end of the bobbin. The second end may be opposite the first end. The bobbin may further include a through-hole extending from the first opening to the second opening. The system may further include an insert having a head, a stem extending from the head, and an attachment member connected to the stem. The stem of the insert may be configured to be inserted into the through-hole of the bobbin through the first opening, and at least a portion of the attachment member may be configured to extend out of the second opening.

The present disclosure provides, in a third aspect, a method for storing or labeling a bobbin. The method may include obtaining a bobbin having a first opening on a first end of the bobbin and a second opening on a second end of the bobbin. The second end may be opposite the first end.

The bobbin may further include a through-hole extending from the first opening to the second opening. The method may further include obtaining an insert having a head, a stem extending from the head, and an attachment member connected to the stem. The method may further include inserting the stem of the insert into the through-hole of the first opening, such that at least a portion of the attachment member may be level with or extend through the second opening.

These, and other objects, features and advantages of this disclosure will become apparent from the following detailed description of the various aspects of the disclosure taken in conjunction with the accompanying drawings.

BRIEF DESCRIPTION OF THE DRAWINGS

The accompanying drawings, which are incorporated in and constitute part of the specification, illustrate embodiments of the disclosure and together with the detailed description herein, serve to explain the principles of the disclosure. It is emphasized that, in accordance with standard practice in the industry, various features are not drawn to scale. In fact, the dimensions of the various features may be arbitrarily increased or reduced for clarity and discussion. The drawings are only for purposes of illustrating preferred embodiments and are not to be construed as limiting the disclosure.

DETAILED DESCRIPTION OF THE INVENTION

Figure 2:
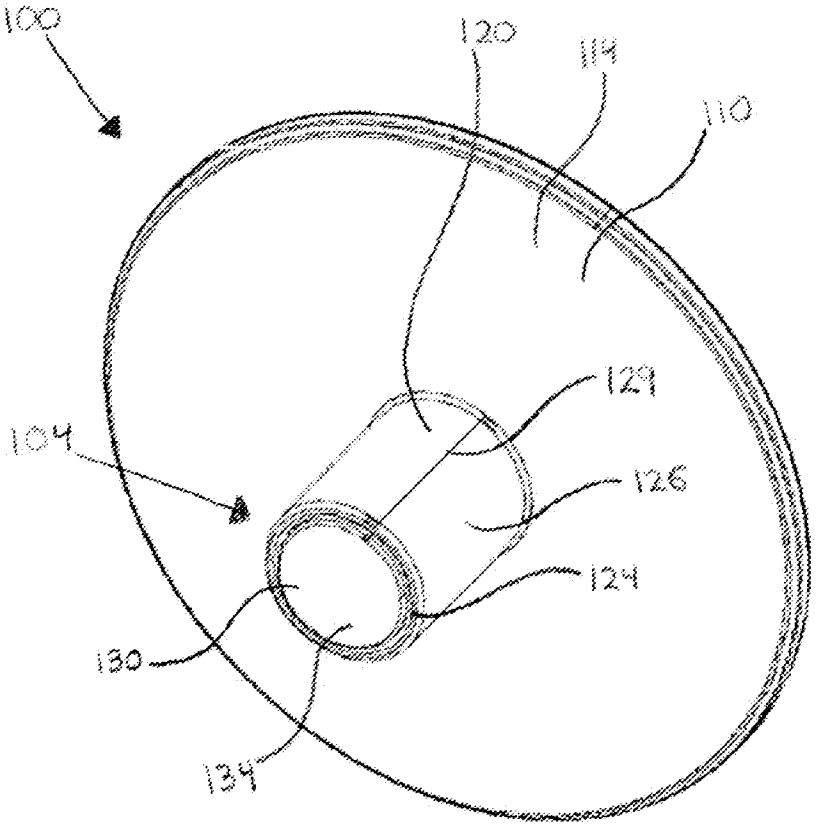
FIG. 2 depicts a second perspective view of the labeling disc of FIG. 1, in accordance with an aspect of the present disclosure.

The present disclosure will be discussed hereinafter in detail in terms of various exemplary embodiments according to the present disclosure with reference to the accompanying drawings. In the following detailed description, numerous specific details are set forth in order to provide a thorough understanding of the present disclosure. It will be obvious, however, to those skilled in the art that the present disclosure may be practiced without these specific details. In other instances, well-known structures are not shown in detail in order to avoid unnecessarily obscuring the present disclosure.

Furthermore, there is no intention to be bound by any expressed or implied theory presented in the preceding technical field, background, brief summary, or the following detailed description. It is also understood that the specific devices and processes illustrated in the attached drawings, and described in the following specification, are simply exemplary embodiments of the invented concepts defined in the appended claims. Hence, specific dimensions and other physical characteristics relating to the embodiments disclosed herein are not to be considered as limiting, unless the claims expressly state otherwise.

Referring to the drawings, wherein like reference numerals are used to indicate like or analogous components throughout the several view, and with particular reference to FIGS. 1-10, devices and systems for storing and labeling spools or bobbins and/or the materials held thereon are shown. Further, methods for using the devices and systems for storing and labeling materials held by the spool or bobbin are discussed.

FIGS. 1-7 depict a labeling device 100 of the present disclosure which has been assembled with a fastening or attachment means 130. The labeling device 100 may also be referred to as a labeling disc, a spool, or bobbin insert. The labeling device 100 may extend from a first end 102 to a second end 104, and may include a head 110 and a stem 120. In some embodiments, the head 110 and the stem 120 may be made, for example, integral, monolithic, as a single piece, or of one-piece construct, with each other. In other embodiments, discussed in more detail below, the head 110 and the stem 120 may be removably connected, as shown in FIGS. 12-17.

In some embodiments, the head 110 may be a disc which is round or circular, as shown in FIGS. 1-7. In other embodiments, the head 110 may be another shape, such as a triangle/trigon, square/tetragon, pentagon, hexagon, heptagon/septagon, octagon, enneagon/nonagon, decagon, or any other polygon. Differently shaped embodiments of the head 110 may be selected, for example, to accommodate the corresponding shape of a spool or bobbin 200, such as shown in FIGS. 18-25, into and/or onto which the labeling device 100 is to be inserted, as described in more detail below.

The head 110 may include a first face or surface 112, a second face or surface 114, and a rim or edge 117. The first surface 112 may be opposite the second surface 114. For example, the first surface 112 may face substantially towards the first end 102, and the second surface 114 may face substantially towards the second end 104. The edge 117 may extend between the first surface 112 and the second surface 114. In some embodiments, the edge 117 may be rounded, or may include one or a plurality of bevels 118.

Figure 1:
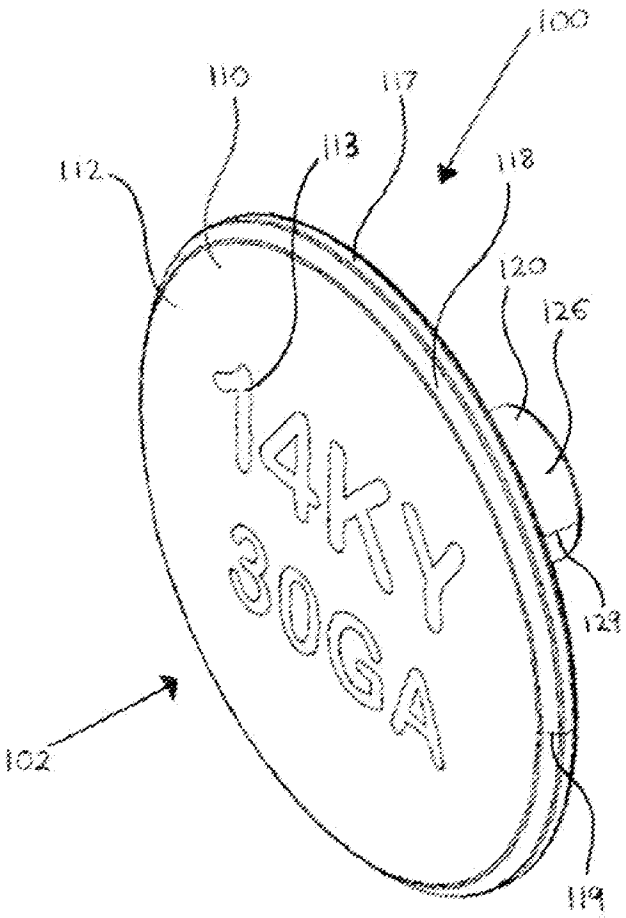
FIG. 1 depicts a first perspective view of a labeling disc which has been assembled with an attachment means, in accordance with an aspect of the present disclosure.
Figure 4:
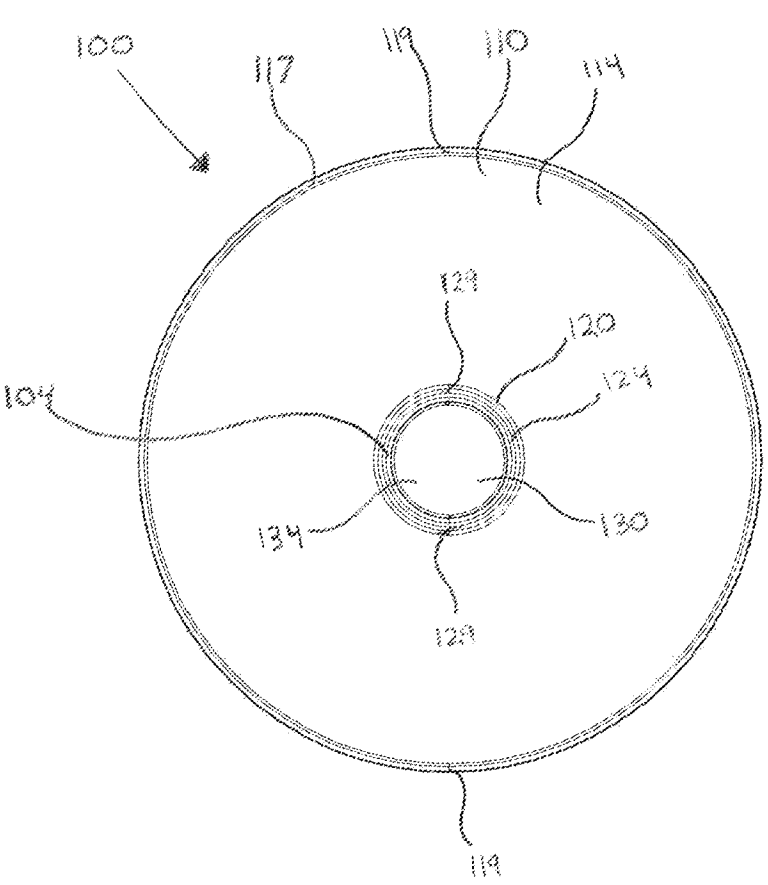
FIG. 4 depicts a bottom view of the labeling disc of FIG. 1, in accordance with an aspect of the present disclosure.

In embodiments, the head 110 may further include a label 113. In some embodiments, the informational label 113 may be located on the first surface 112 of the head, as shown in FIG. 1. The label 113 may be, for example, an informational label containing information that may be read or otherwise understood by a user of the labeling device 100. The information on the label 113 may indicate or correspond to a type and/or size of material held on the spool or bobbin 200 into which the labeling device 100 is to be inserted during a storing and/or labeling of the material and/or the spool or bobbin 200, as discussed in more detail below with respect to a system 10 of the present disclosure. The informational label 113 may be part of a mold from which the head 110 is made or may be 3D printed, such that the label 113 is formed integrally with the head 110. Alternatively, the informational label 113 may be carved, etched, or engraved onto the head 110 after the head 110 has been formed. Preferably, the label 113 is physically formed on or to the head 110 in the ways just described to increase the permanency of the label 113, making it less likely that the label 113 wears off or becomes unreadable over time.

In embodiments, the label 113 may be its own component, separate from the head 110. The head 110 may thus be configured to detachably receive the label 113, for example, on the first surface 112. The ability to remove the label 113 may provide an option for users to update or change the informational content of the label 113, which may help address the dynamic needs associated with different materials and/or usage scenarios without the need to modify or change the entire head 110. The removable and/or detachable nature of the label 113 in some embodiments thus enhances the flexibility of the labeling device 100 as a whole, allowing for information to be easily updated to reflect the current contents of the spool or bobbin 200 being labeled.

In embodiments where the label 113 is its own separate component from the head 110, the label 113 may be secured and/or affixed to the head 110 through a variety of means. For example, the label 113 may be secured and/or affixed to the head using a precision-fit slot, a magnetic attachment, a repositionable adhesive, and/or any other means which one skilled in the art would know and understand to be sufficient to secure and/or affix the label 113 to the head 110 such that the label 113 remains in place during use of the labeling device 100 while also permitting easy removal and/or replacement, as needed. The label 113 may itself be crafted from durable materials, such as laminated paper, thin plastic, metal, and/or any other material or combination of materials which one skilled in the art would know and understand to be sufficient to ensure that the label 113 withstands use under typical environmental and handling conditions while maintaining the integrity of the information displayed thereon.

Figure 3:
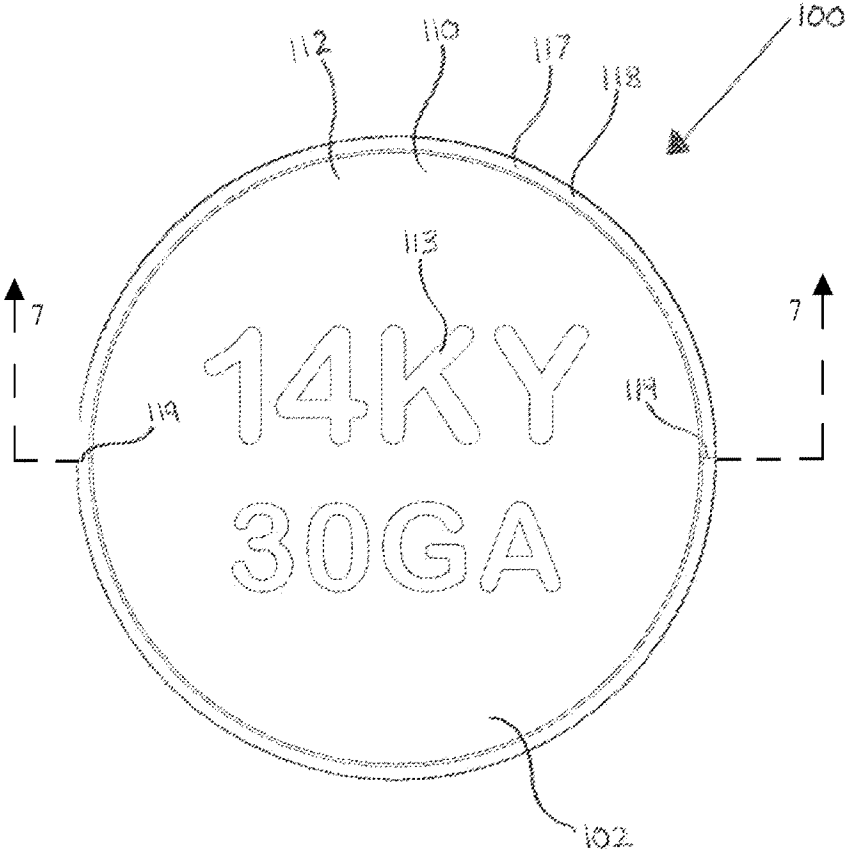
FIG. 3 depicts a top view of the labeling disc of FIG. 1, in accordance with an aspect of the present disclosure.
Figure 5:
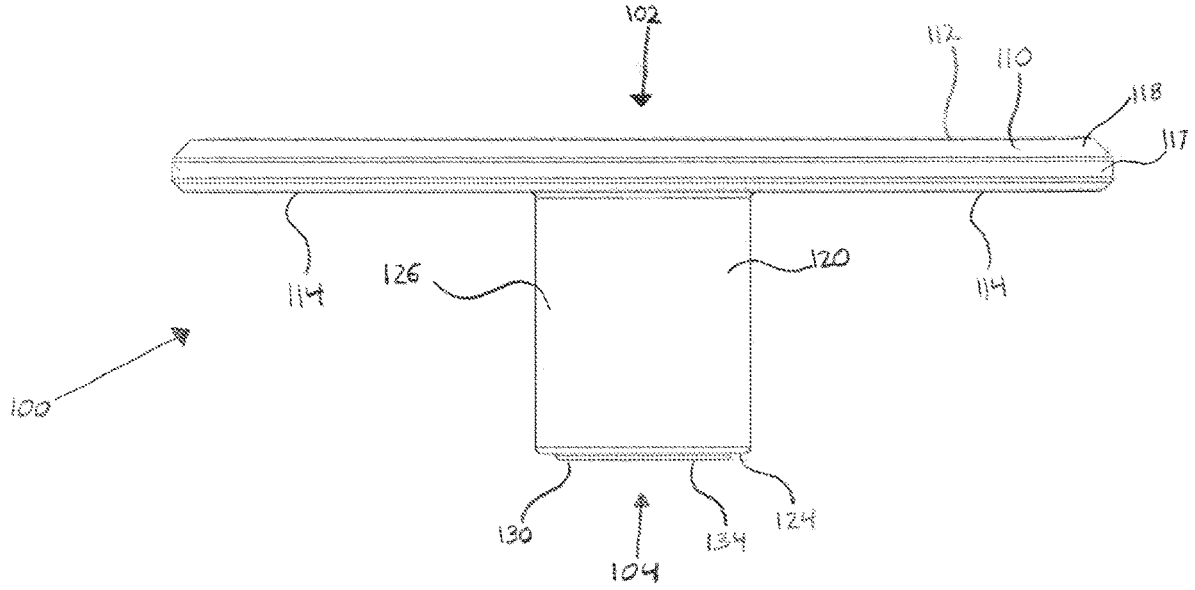
FIG. 5 depicts a first side view of the labeling disc of FIG. 1, in accordance with an aspect of the present disclosure.
Figure 6:
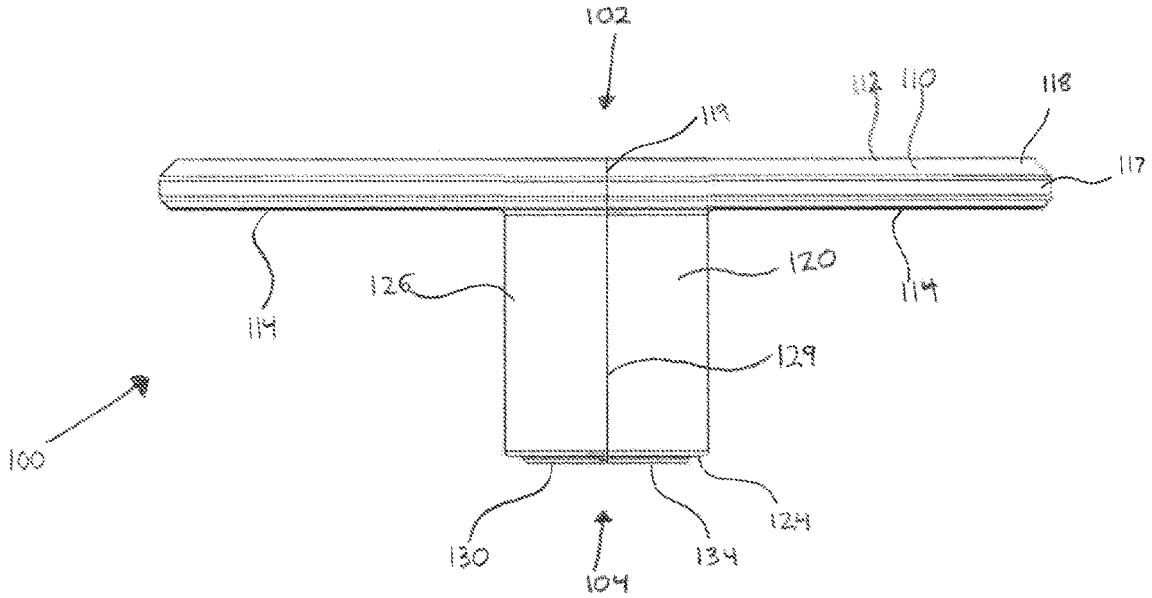
FIG. 6 depicts a second side view of the labeling disc of FIG. 1, in accordance with an aspect of the present disclosure.
Figure 7:
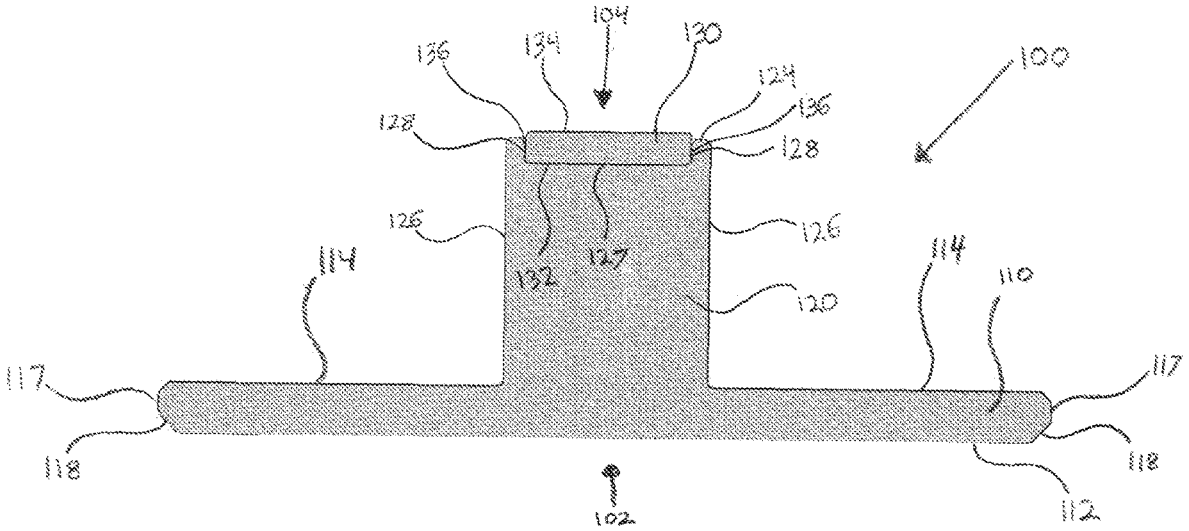
FIG. 7 depicts a cross-sectional view of the labeling disc of FIG. 1 taken along line 7-7 in FIG. 3, in accordance with an aspect of the present disclosure.
Figure 8:
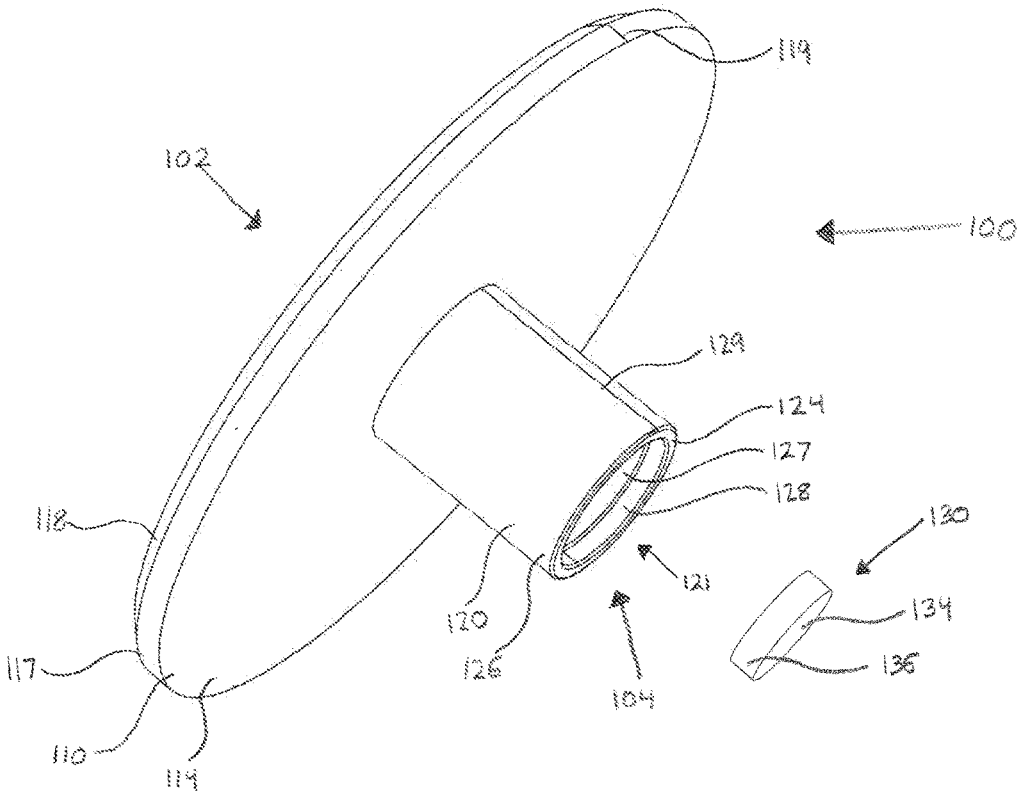
FIG. 8 depicts an exploded perspective view of the labeling disc and attachment means of FIG. 1, in accordance with an aspect of the present disclosure.
Figure 9:
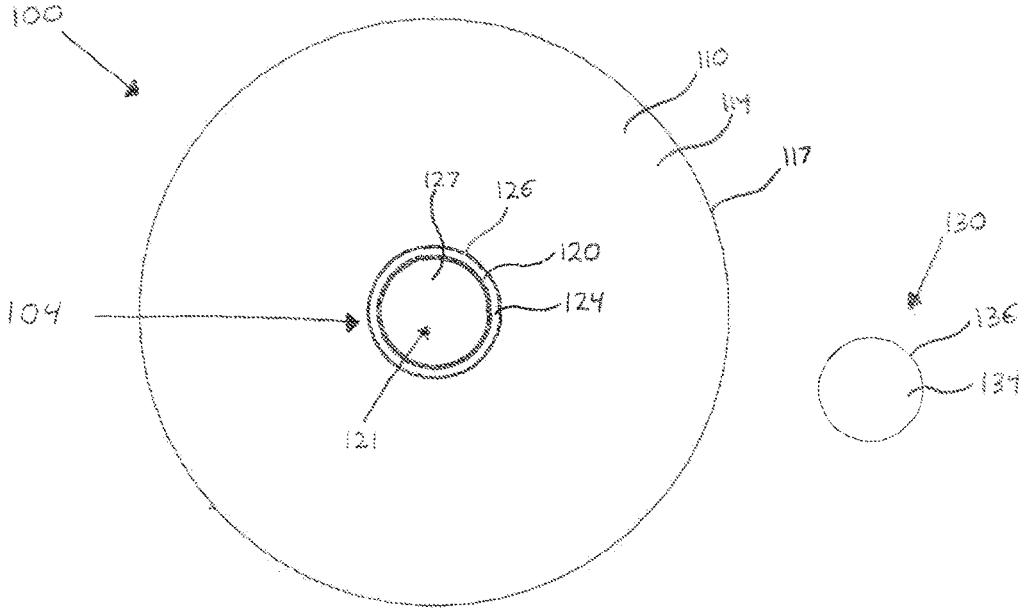
FIG. 9 depicts an exploded bottom view of the labeling disc and attachment means of FIG. 1, in accordance with an aspect of the present disclosure.
Figure 10:
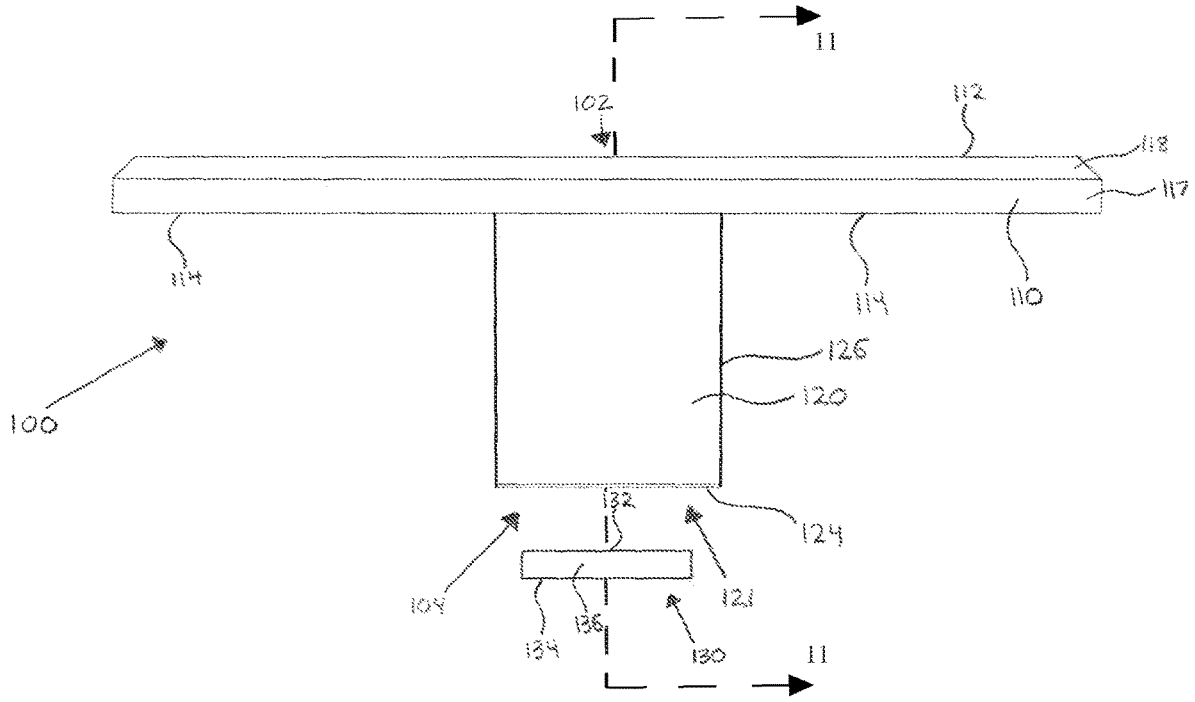
FIG. 10 depicts an exploded side view of the labeling disc and attachment means of FIG. 1, in accordance with an aspect of the present disclosure.
Figure 11:
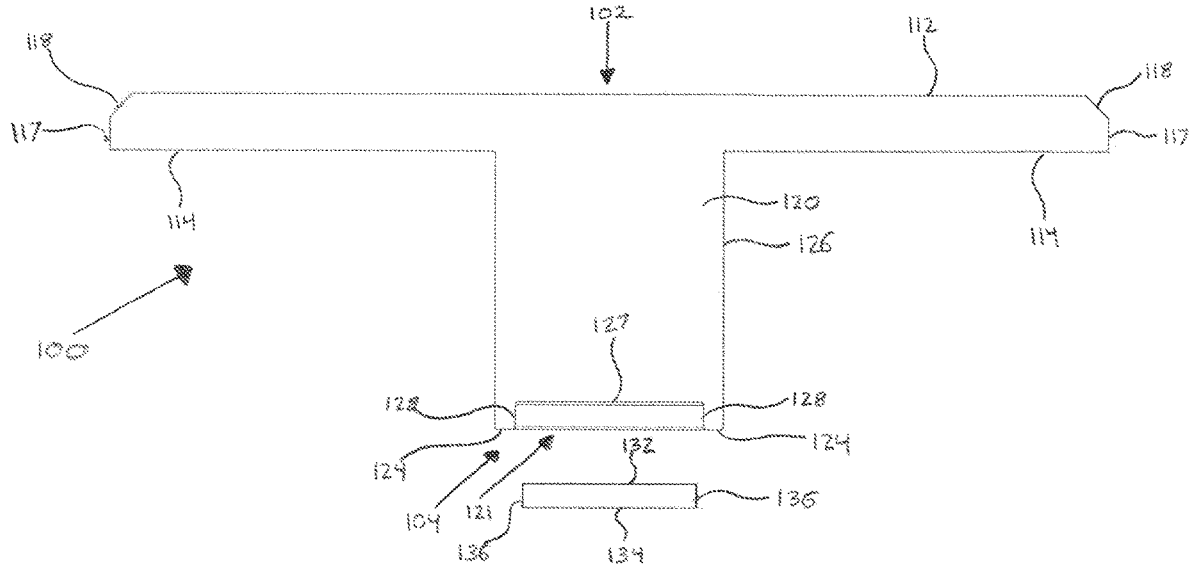
FIG. 11 depicts an exploded side cross-sectional view of the labeling disc and attachment means of FIG. 1 taken along line 11-11 in FIG. 10, in accordance with an aspect of the present disclosure.
Figure 12:
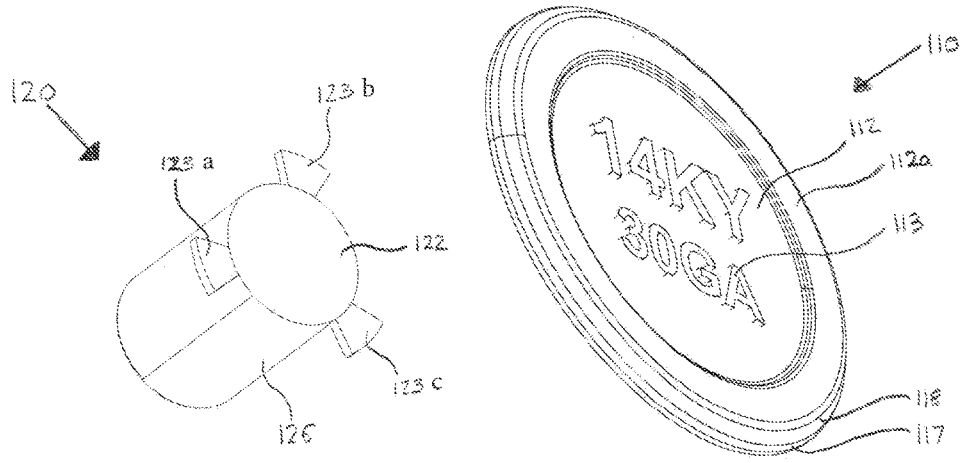
FIG. 12 depicts a first exploded perspective view of a head and a stem of the labeling disc of FIG. 1, in accordance with an aspect of the present disclosure.
Figure 13:
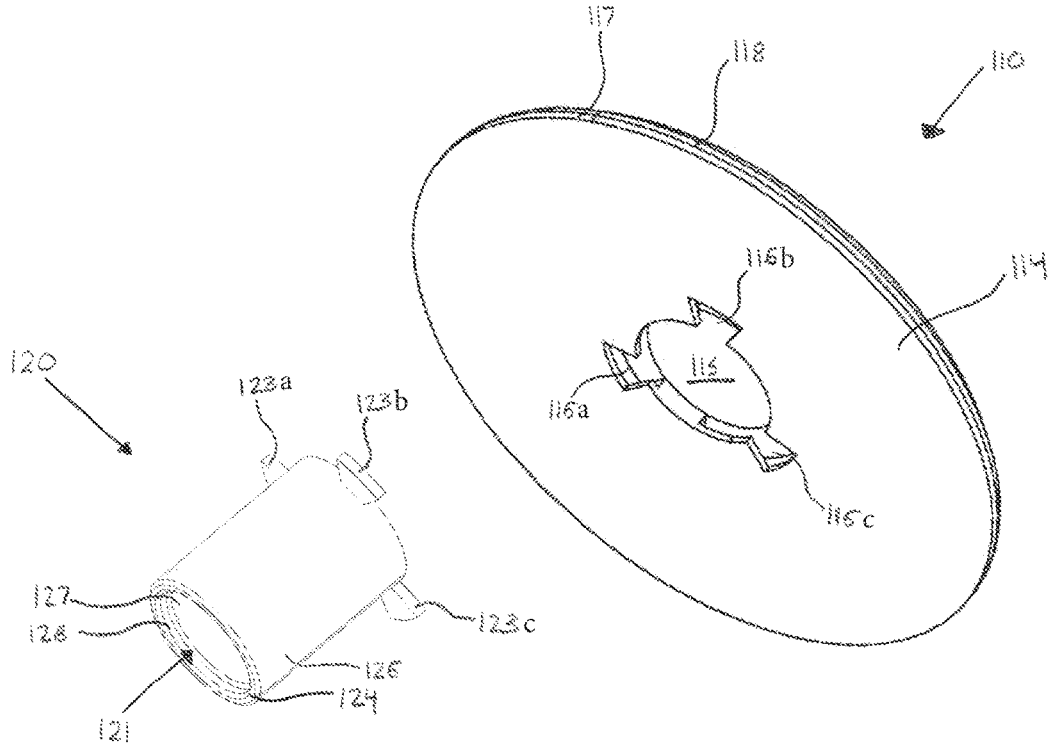
FIG. 13 depicts a second exploded perspective view of the head and stem of the labeling disc of FIG. 1, in accordance with an aspect of the present disclosure.
Figure 14:
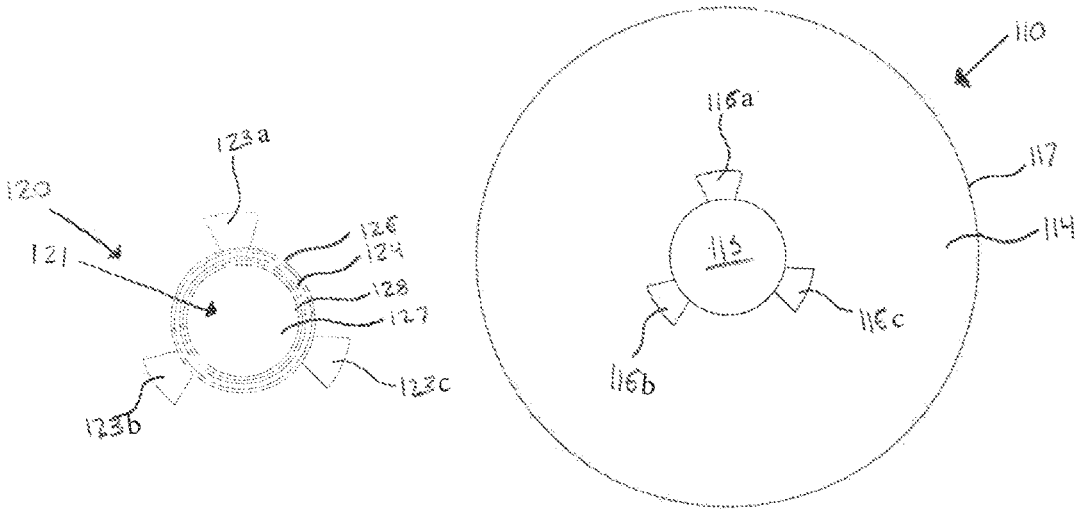
FIG. 14 depicts an exploded bottom view of the head and stem of the labeling disc of FIG. 1, in accordance with an aspect of the present disclosure.
Figure 15:
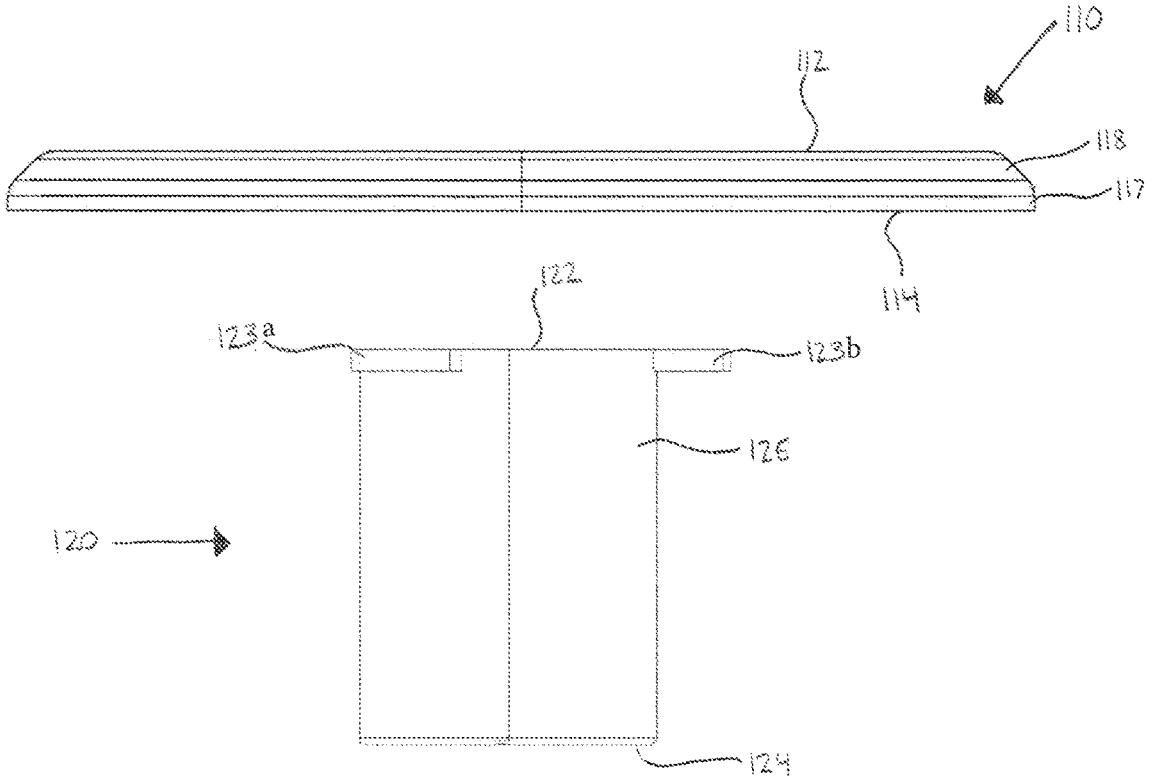
FIG. 15 depicts a first exploded side view of the head and stem of the labeling disc of FIG. 1, in accordance with an aspect of the present disclosure.
Figure 16:
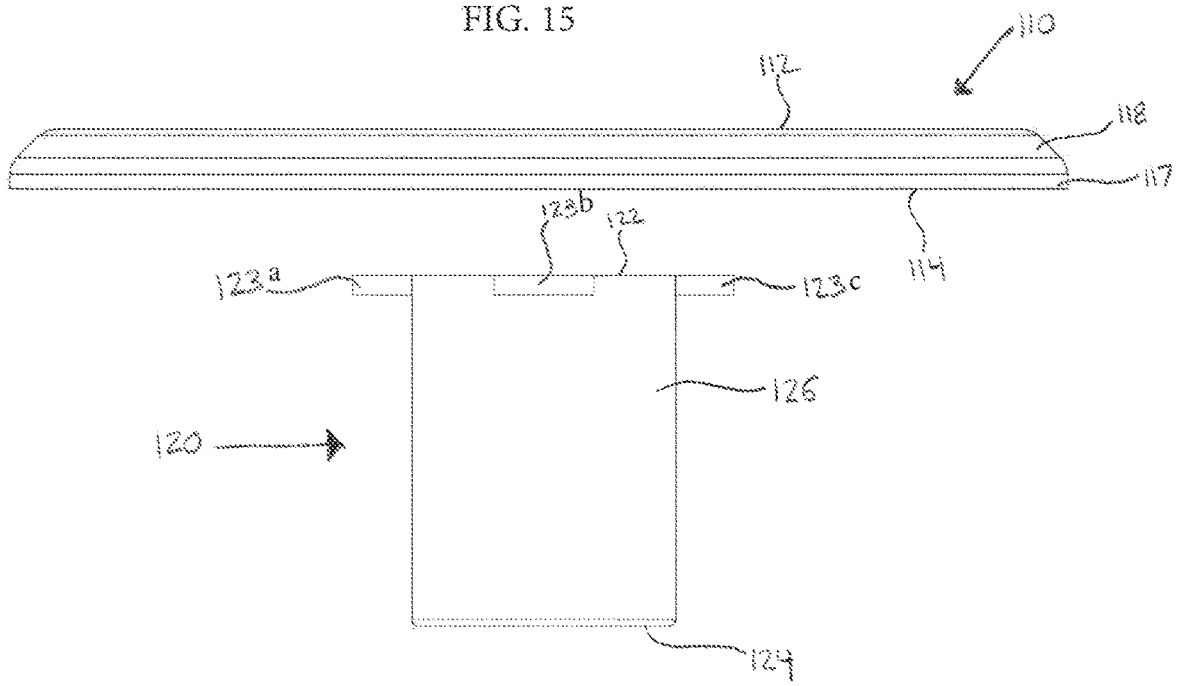
FIG. 16 depicts a second exploded side view of the head and stem of the labeling disc of FIG. 1, in accordance with an aspect of the present disclosure.
Figure 17:
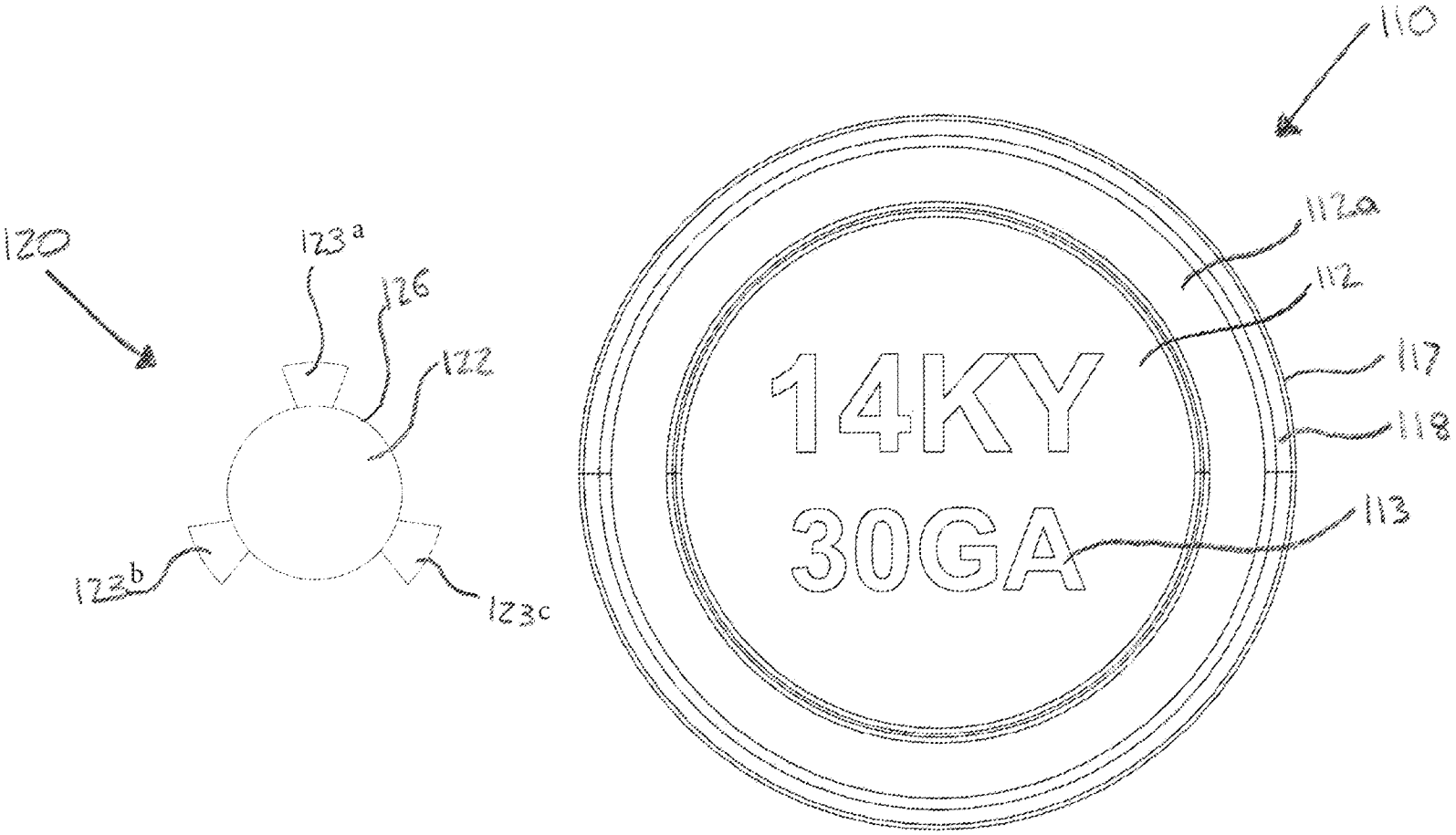
FIG. 17 depicts an exploded top view of the head and stem of the labeling disc of FIG. 1, in accordance with an aspect of the present disclosure.
Figure 18:
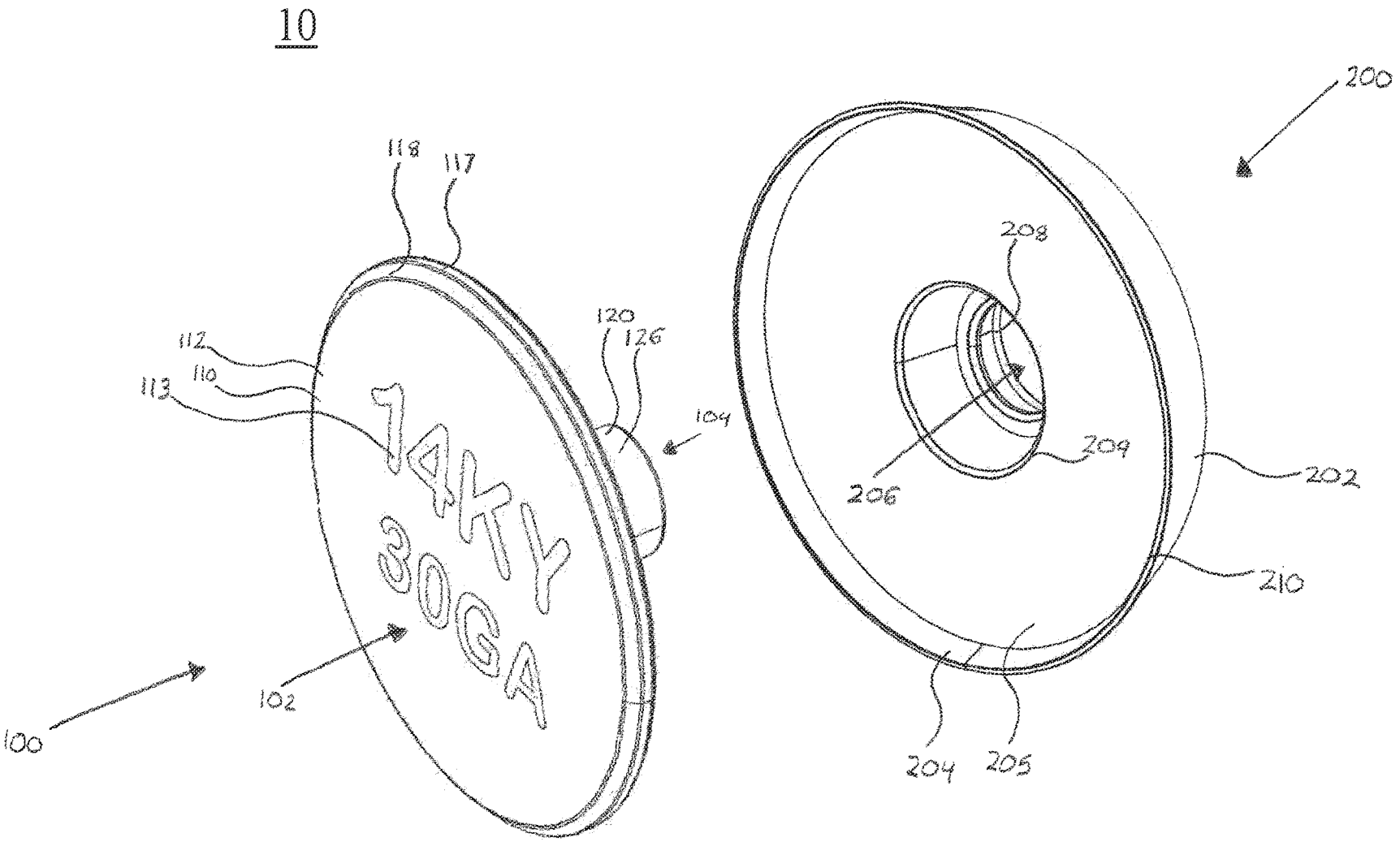
FIG. 18 depicts a first exploded perspective view of the labeling disc of FIG. 1 and a spool or bobbin, in accordance with an aspect of the present disclosure.
Figure 19:
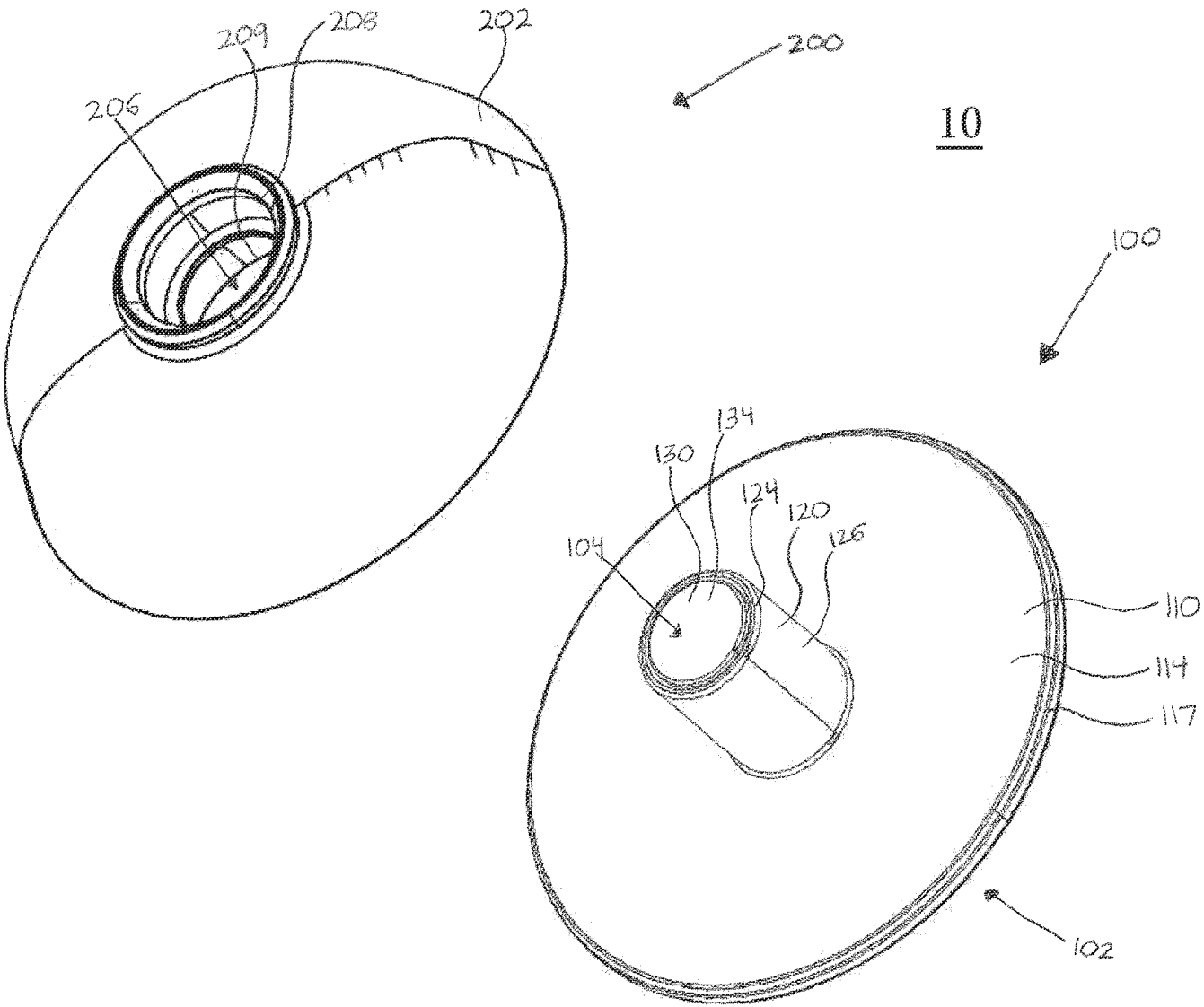
FIG. 19 depicts a second exploded perspective view of the labeling disc of FIG. 1 and the spool or bobbin of FIG. 18, in accordance with an aspect of the present disclosure.
Figure 21:
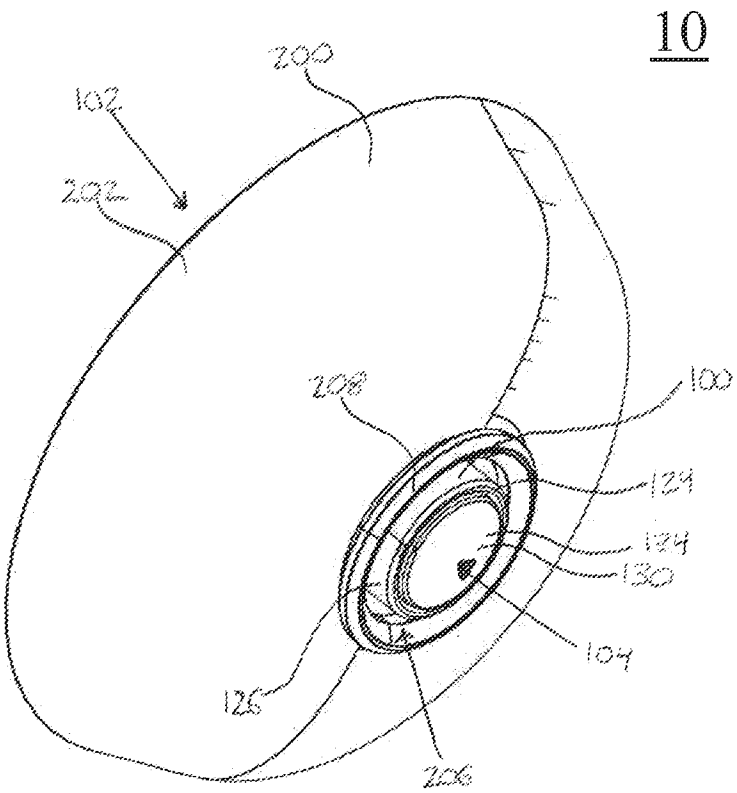
FIG. 21 depicts a second perspective view of the labeling disc of FIG. 1 coupled with the spool or bobbin of FIG. 18, in accordance with an aspect of the present disclosure.

The stem 120 may include a bottom face or surface 124 and a radial surface or exterior surface 126, as shown in FIGS. 1-2 and 4-7. The stem 120 may be attached to or extend from the head 110. For example, the stem 120 may extend from the second surface 114, such that the stem 120 is opposite the label 113 about the head 110. Thus, in the example, the bottom surface 124 may be at the second end 104 of the labeling device 100. As shown in FIG. 3, the stem 120 may extend from substantially the center of the second surface 114. However, in other embodiments, the stem 120 may extend from the head 110 at any location which permits the stem 120 to be inserted into the spool or bobbin 200, such that the label 113 is visible from an exterior of the spool or bobbin 200, as described in more detail below. The stem 120 may extend from the head 110, for example, perpendicular to the second or bottom surface 114 of the head 110. It is also contemplated that in some embodiments the stem 120 may extend from the head 110 at an angle greater than or less than 90 degrees.

Turning to FIGS. 7-11, the stem 120 may further include a cavity 121 disposed, for example, towards the second end 104 of the labeling device 100. For example, the cavity 121 may have an opening which is bound by the bottom surface 124. The cavity 121 may further extend from the bottom surface 124 into at least a portion of the stem 120 in a direction from the second end 104 towards the first end 102 of the labeling disc 100. In the embodiment shown, the cavity 121 may include a flat surface 127 and a radial surface 128. The flat surface 127 may be, for example, positioned at the interior-most portion of the cavity 121. The radial surface or interior surface 128 may extend from the bottom surface 124 of the stem 120 to the flat surface 127. The cavity 121 may further be configured or sized and shaped to receive an attachment means 130.

Figure 22:
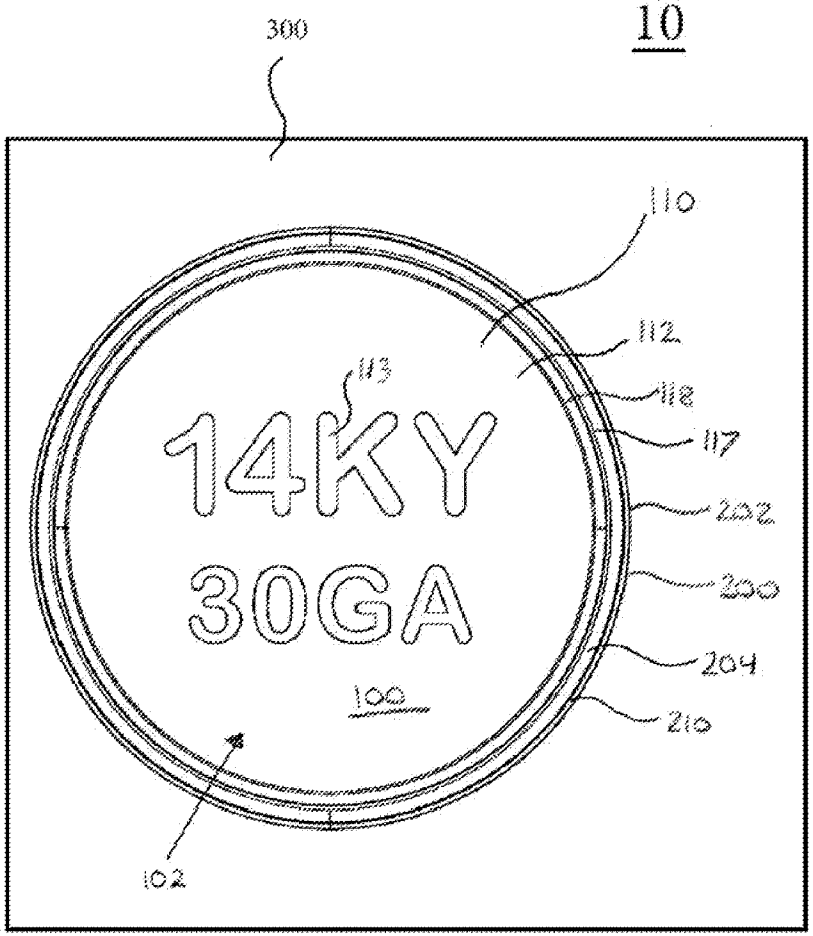
FIG. 22 depicts a top view of the labeling disc of FIG. 1 coupled with the spool or bobbin of FIG. 18 and an exterior surface, in accordance with an aspect of the present disclosure.
Figure 24:
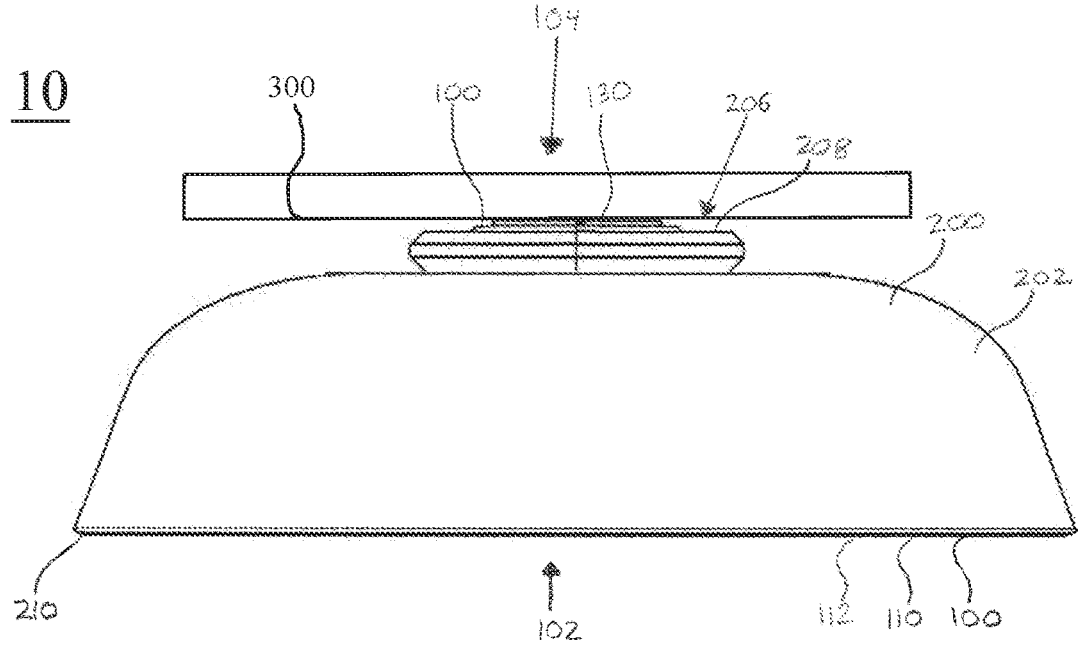
FIG. 24 depicts a side view of the labeling disc of FIG. 1 coupled with the spool or bobbin of FIG. 18 and the exterior surface of FIG. 22, in accordance with an aspect of the present disclosure.

In some embodiments, the attachment means 130 may be integrally formed with or permanently attached to the stem 120. In other embodiments, the attachment means 130 may be removably received on or in the stem 120, such as in the cavity 121. In the example shown in FIGS. 1-11, the attachment means 130 may be a magnet. In the example of a magnet, the attachment means 130 may be inserted into the cavity 121 such that an upper surface 132 of the attachment means 130 contacts and/or couples to the flat surface 127 of the cavity 121. With the attachment means 130 within the cavity 121, at least a portion of a radial or exterior surface 136 of the attachment means 130 may contact the radial surface 128 of the cavity 121. When the attachment means 130 is received or otherwise located in the cavity 121 as described, at least a bottom surface 134 of the attachment means 130 may be exposed to an exterior of the labeling device 100. The exposed bottom surface 134 may permit the attachment means 130, and thus the labeling device 100, to engage with and/or be secured to an mounting surface 300, as shown in FIGS. 22 and 24, such as a wall, table, rack, or other surface. The exposed bottom surface 134 may, for example, extend beyond the bottom surface 124 of the stem 120. In other embodiments, the bottom surface 134 of the attachment means 130 may be flush with the bottom surface 124 of the stem 120.

Other embodiments of the present disclosure may include a different variant or variations of the attachment means 130. For example, the attachment means 130 may be one, multiple or a combination of a lock-in-key type mechanism(s), friction fit mechanism(s), snap-fit mechanism(s), magnet(s), touch fastener(s), adhesive(s), suction cup(s), clip(s), clamp(s), and the like as would be known and/or understood by one of ordinary skill in the art. Put simply, the attachment means 130 may be any element or mechanism which permits the labeling device to engage with the desired mounting surface 300, for example, a wall, table, rack, etc., as described in more detail below.

In some embodiments, such as where the attachment means 130 is a magnet, there may be a plurality of the mounting surfaces 300, such as a plurality of walls and/or tables made of metal, all of which are able to engage with the attachment means 130. In the example, the attachment means 130 may therefore permit a user to attach the labeling device 100, and thus the spool or bobbin 200, to a variety of surfaces within a given space, such as a workshop, as needed.

Where the attachment means 130 includes one or multiple suction cups, the suction cups may allow for easy attachment and removal from the mounting surface 300 without leaving undesirable marks or residues thereon. In some embodiments, such as where the attachment means 130 includes one or multiple suction cups, clips and/or clamps, among other embodiments, the attachment means 130 may securely attach to edges and/or surfaces of the mounting surface 300 without the need for adhesives, which may help preserve the integrity of the mounting surface 300. In some embodiments, such as where the attachment means includes one or multiple snap-fit connectors or lock-in-key type mechanisms, among other embodiments, the attachment means 130 may provide a reusable and secure means of attaching the labeling device 100 to the mounting surface 300 through the interlocking of parts, allowing for easy assembly and disassembly. In such embodiments, the mounting surface 300 may include components such as holes, pegs, or other structures to which the attachment means 130 is capable of engaging and/or coupling.

Depending on the chosen embodiment of the attachment means 130, the cavity 121 may be shaped differently than shown and/or may extend into the stem 120 to different distances or depths. In further embodiments, the labeling device 100 may not include the cavity 121 at all. For example, where the attachment means 130 may be an adhesive strip, there may be no cavity 121 extending into the stem 120, and instead there may only be the bottom surface 124. In such an embodiment, the bottom surface 124 may be substantially flat, flush, planar, or the like as understood by one of ordinary skill in the art, and the attachment means 130 may be connected thereto. Further, in such an embodiment, an adhesive of the attachment means 130 may be disposed or faced away from the labeling device 100 to permit the labeling device 100 to be attached to the mounting surface 300 of the storage device.

In embodiments where the head 110 and the stem 120 are removably connected, the labeling device 100 may further include an attachment, fastening, or locking mechanism to detachably connect or secure the head 110 and the stem 120. In an embodiment shown in FIGS. 12-17, the locking mechanism may include corresponding structures on the head 110 and on the stem 120 which are configured to facilitate the connection between the head 110 and the stem 120 to form the assembled labeling device 100. For example, the head 110 may further include a cavity 115 and/or a plurality of slots 116, and the stem 120 may further include a top surface 122 and a plurality of extensions or protrusions 123. The top surface 122 may be configured to be removably received in the cavity 115. Further, each protrusion 123*a*, 123*b*, 123*c* of the plurality of protrusions 123 may be configured to be removably received in a slot 116*a*, 116*b*, 116*c* of the plurality of slots 116. After each protrusion 123*a*, 123*b*, 123*c* has been inserted into their respective slot 116*a*, 116*b*, 116*c*, a twisting or rotating motion applied in a first direction to the head 110 relative to the stem 120, or of the stem 120 relative to the head 110, may be sufficient to lock, attach, fasten and/or secure the head 110 and stem 120 to each other. In such an embodiment, a twisting or rotating motion applied in a second direction to the head 110 relative to the stem 120, or of the stem 120 relative to the head 110, may be sufficient to unlock, detach, and/or unfasten the head 110 and stem 120 from each other. In embodiments, the second direction in which the twisting or rotating motion is applied may be opposite the first direction. In other embodiments, the locking mechanism may be different from the embodiment described above, and may be any type of locking mechanism which is already known by one of skill in the art to be effective in locking, attaching, fastening and/or securing together two parts.

The labeling device 100 may be made and/or formed of any suitable material which is rigid enough to hold the spool or bobbin 200 when the labeling device 100 is attached to the mounting surface 300. Preferably, the labeling device 100 may be formed of a substantially rigid material such as a plastic or metal. In some embodiments, the labeling device 100 may be 3D printed with polylactic acid (PLA), acrylonitrile butadiene styrene (ABS), acrylonitrile styrene acrylate (ASA), polyethylene terephthalate glycol (PETG), nylon, polycarbonate, polypropylene, polyether ether ketone (PEEK) or another thermoplastic.

In some embodiments, the labeling device 100 may include one or multiple textured surfaces. The textured surface(s) may be formed through mechanical processing, chemical treatment, additive manufacturing techniques, or the like which one skilled in the art would know and understand to be sufficient to form the textured surface(s). The textured surface(s) may be formed on and/or around the labeling device 100 or portions thereof (e.g., on and/or around the head 110, the stem 120, and/or other components described above) during and/or after manufacturing. For example, in some embodiments the textured surface(s) may be formed at the same time as the labeling device 100 or portions thereof, such as by 3D printing the labeling device 100 or portions thereof onto a textured build plate (e.g., a PEI plate). In such an embodiment, the manufacturing of the labeling device 100 or portions thereof may be completed with the textured surface(s) already formed thereon. In further embodiments, the textured surface(s) may be formed on and/or around the labeling device 100 or portions thereof after manufacturing, for example, by adding an additional layer of material on top of the already completed components. In even further embodiments, the textured surface(s) may be formed on and/or around the labeling device 100 or portions thereof after manufacturing, for example, by removing and/or eroding materials from the already completed components.

In some embodiments, textured surfaces of the labeling device 100 may increase the ability of a user to grasp the labeling device 100, such as when inserting the labeling device 100 into the spool or bobbin 200. In some embodiments, the textured surfaces may be part of the attachment means 130 which allow the attachment means 130 to form connections such as a friction fit with the mounting surface 300, as described above.

Turning now to FIGS. 18-25, a system 10 of the present disclosure may include the labeling device 100, including, the combined or integrally formed head 110 and stem 120, the spool or bobbin 200, and/or the mounting surface 300. The spool or bobbin 200 may include an outer surface 202, a first inner surface 204, a second inner surface 205, and a through-hole 206. The spool 200 may also include a first opening 208 of the through-hole 206 extending through the outer surface 202 and a second opening 209 of the through-hole 206 extending through the second inner surface 205. The through-hole 206 of the spool or bobbin 200 may extend from the first opening 208 to the second opening 209. The first inner surface 204 may terminate in a third opening or recessed region 210.

In the examples shown in FIGS. 18-25, the spool or bobbin 200 may be a kumihimo bobbin. However, in other embodiments, the spool or bobbin 200 may be a traditional spool or bobbin of the kind used to hold and/or store various types of wires. In even further embodiments, the spool or bobbin 200 may be a traditional spool or bobbin of the kind used in sewing (e.g., holding thread). The dimensions of the labeling device 100 may vary depending on the dimensions and/or type of the spool or bobbin 200 into which the labeling device 100 is to be inserted. For example, the stem 120 may be sized and shaped to engage a through-hole (e.g., the through-hole 206) of a spool or bobbin (e.g., the spool or bobbin 200) the labeling device 100 will be used with. In addition, the head 110 may be, for example, sized and shaped to be the same size or smaller than the size of the third opening or recessed region 210 of the spool or bobbin 200. As the system 10 and method are discussed below, it is assumed that the kumihimo spool or bobbin 200 is in a closed configuration which is typical of such spools or bobbins during storage. However, the labeling device 100 may be inserted into the spool or bobbin 200 regardless of whether it is in the closed configuration as shown or in an open configuration in which the materials held on the spool or bobbin 200 are exposed.

The stem 120 of the labeling device 100 may be configured to be inserted into the through-hole 206 of the spool or bobbin 200. For example, the stem 120 of the labeling device 100 may be inserted into the spool or bobbin 200 through the third opening 210 and the second opening 209, such that a portion of the stem 120 or the attachment means 130 extends to and/or through the first opening 208. To ensure the attachment means 130 may contact the mounting surface 300, a dimensions (e.g., shape, length and width) of the stem 120 may be based on the dimensions (e.g., shape, length and width) of the through-hole 206. Thus, when the labeling device 100 has been inserted into the spool or bobbin 200, as shown in FIGS. 21-23 and 25, the stem 120 may extend into and/or through the through-hole 206. Said another way, when the labeling device 100 is inserted into the spool or bobbin 200, the radial surface 126 of the stem 120 may be located substantially in the through-hole 206. For example, the stem 120 may extend through the through-hole 206 from the second opening 209 to the first opening 208, such that the attachment means 130 is flush with the first opening 208 to permit contact with the mounting surface 300. Alternatively, the stem 120 may extend through the through-hole 206 such that the attachment means 130 extends beyond the first opening 208 in a direction from the second opening 209 towards the first opening 208 to permit contact with the mounting surface 300.

Figure 20:
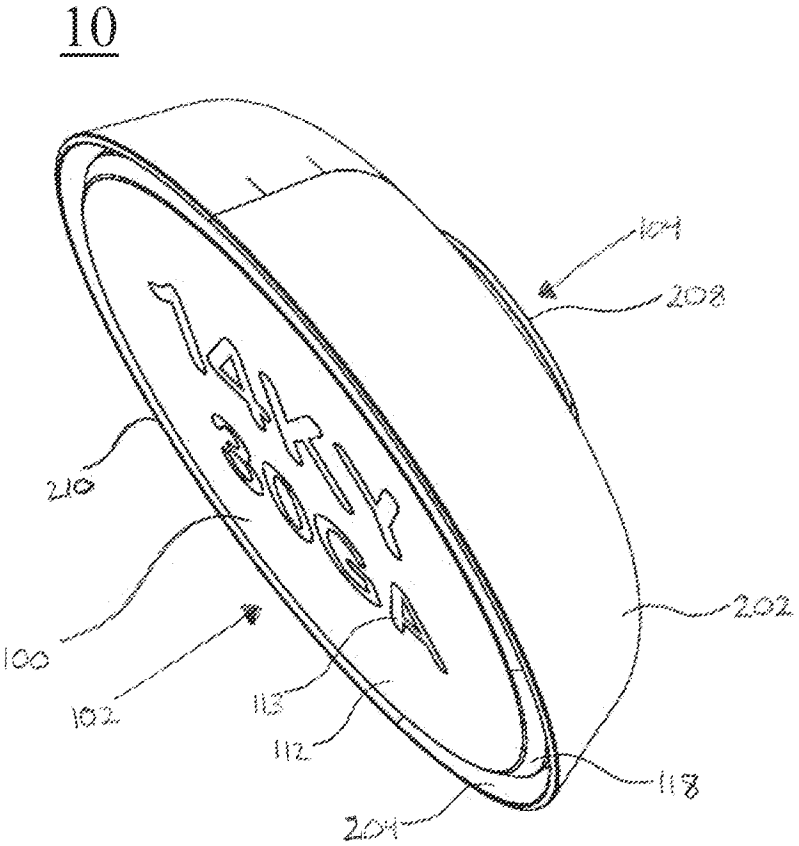
FIG. 20 depicts a first perspective view of the labeling disc of FIG. 1 coupled with the spool or bobbin of FIG. 18, in accordance with an aspect of the present disclosure.
Figure 23:
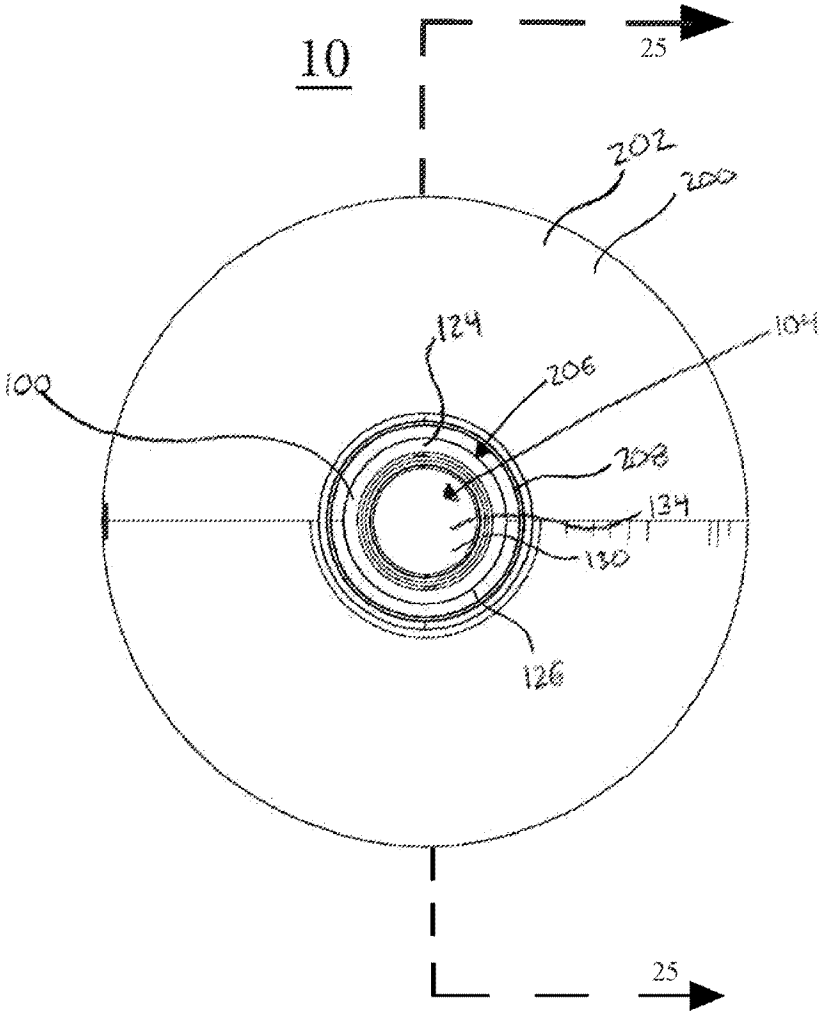
FIG. 23 depicts a bottom view of the labeling disc of FIG. 1 coupled with the spool or bobbin of FIG. 18, in accordance with an aspect of the present disclosure.
Figure 25:
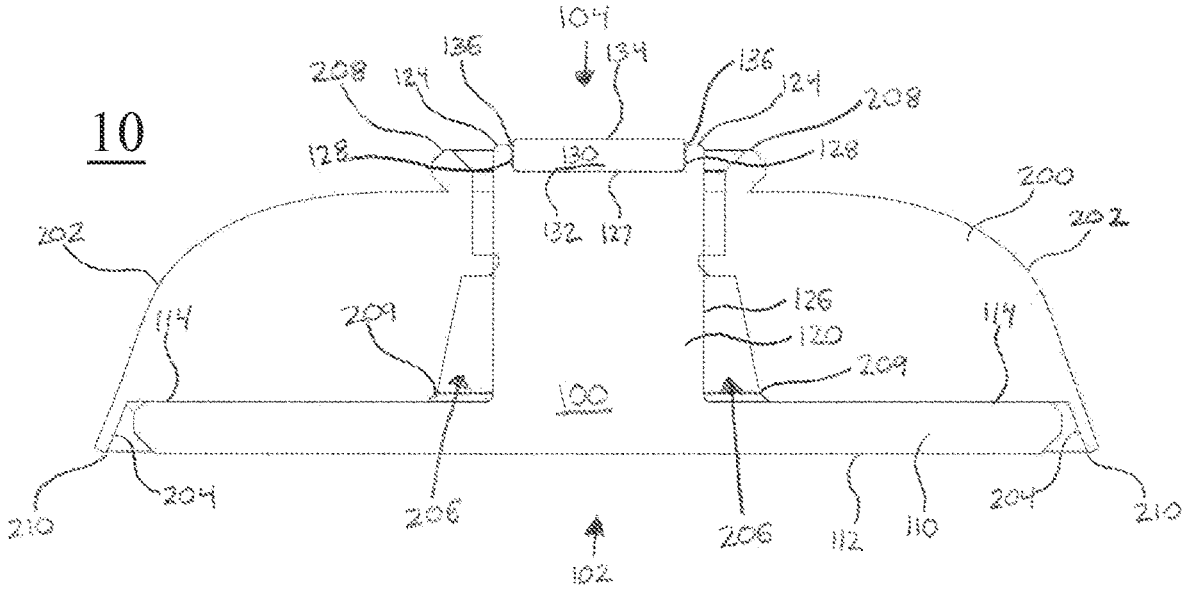
FIG. 25 depicts a cross-sectional side view of the labeling disc of FIG. 1 coupled with the spool or bobbin of FIG. 18 taken along line 25-25 in FIG. 23, in accordance with an aspect of the present disclosure.

When the labeling device 100 is inserted into the spool or bobbin 200, the head 110 of the labeling device 100 may be configured or sized and shaped to contact and/or cover the first inner surface 204 and/or the second inner surface 205. The head 110 may also be configured and/or sized and shaped to be received in the third opening or recess 210. For example, when the stem 120 is present in the through-hole 206 as described above, the edge 117 of the head 110 may contact or cover at least a portion of the first inner surface or interior wall 204, as shown in FIGS. 20, 22 and 25. Further, in the example, when the stem 120 is present in the through-hole 206, the head 110 may contact, cover, and/or obscure all or only a portion of the second inner surface 205. A radius and/or width of the head 110 may thus be determined by the radius and/or width of the first inner surface 204 and/or of the second inner surface 205. For example, the radius and/or width of the head 110 may be slightly smaller than a radius and/or width of the first inner surface 204 at the point of the first inner surface 204 at which the head 110 is to be received. Further, the radius and/or width of the head 110 may be slightly smaller than a radius and/or width of the second inner surface 205 to permit the labeling device 100 to abut the second inner surface 205. In some embodiments, there may be a small amount of space separating the head 110 from either the first inner surface 204 and/or the second inner surface 205 (FIG. 25). The bevel(s) 118 may help protect the first inner surface 204 from wear which otherwise may result from the first inner surface 204 rubbing against a sharp edge. Alternatively, the radius and/or width of the head may be determined by a radius and/or width of the third opening 210.

In some embodiments, the spool or bobbin 200 may include only the second inner surface 205 and not the first inner surface 204. In such an embodiment, the second inner surface 205 may act as a flat or planar base of the spool or bobbin 200, and there may be no third opening or recessed region 210 to receive the head 110 as described above. Thus, in such an embodiment, when the stem 120 is received in the through-hole 206, the lower surface 114 of the head 110 may contact and/or abut the second inner surface 205, such that the edge 117 of the head 110 is flush and/or aligned with an edge and/or circumference (not shown) of the inner surface 205.

Where the labeling device 100 includes a removably connected head 110 and stem 120, the system 10 may include a plurality of heads 110, each differing from the others only in the information contained in the informational label 113. For example, the label shown in FIGS. 20, 22 and 25 reads "14KY 30GA." Thus, for purposes of the example, the label 113 may indicate a 30-gauge, 14-karat yellow gold jewelry wire. However, there may be another head 110 (not shown) which instead indicates a different material, such as "24KY 22GA" (22-gauge, 24-karat yellow gold jewelry wire). The plurality of heads 110 may be configured to be substituted for one another as needed, such as when the material type and/or size held by a spool or bobbin 200 is changed, to indicate the correct material being held. In addition, the plurality of heads 110 may have, for example, not only different labels 113, but also different sizes and/or shapes. Further, the system 10 may include a plurality of stems 120, each differing from the other in length and/or diameter. Thus, the plurality of heads 110 and the plurality of stems 120 with different labels, sizes and shapes enable a user to assemble the specific labeling device 100 needed for each specific spool or bobbin (e.g., for different variations of the spool or bobbin 200).

In further embodiments the system 10 may include a plurality of labeling devices 100 and/or a plurality of spools and/or bobbins 200. For example, where the head 110 and stem 120 are made integrally with each other, there may be a single labeling device 100 for each spool and/or bobbin 200 and/or each variety and/or type and/or size of material held by each spool and/or bobbin 200.

When the labeling device 100 is inserted into the spool or bobbin 200 as described above, the label 113 may be visible when viewing the labeling device 100 and/or the spool or bobbin 200 in a direction substantially from the first end 102 towards the second end 104. For example, the label 113 may be visible such that a user would see or read the label 113, or otherwise understand from the label 113, that the spool or bobbin 200 contains or holds a given size and type of wire, for example, a 30-guage, 14 karat yellow gold jewelry wire.

During storage of the spool or bobbin 200, the attachment means 130 may be configured and/or sized and shaped to be attached to the mounting surface 300. The mounting surface 300 may be any surface which is intended to be used to store the spool or bobbin 200 via the labeling device 300. Continuing with the example above in which the attachment means 130 is a magnet, the mounting surface 300 may be a magnetic surface such as a metal sheet, table, wall, rack, and the like sufficient to form a magnetic connection with the attachment means 130. In such an example, when the labeling device 100 is inserted into the spool or bobbin 200 as described above, the attachment means 130 may connect to the mounting surface 300 to secure the labeling device 100 and the spool or bobbin 200 to the mounting surface 300. Further, in the example, the spool or bobbin 200 may be located substantially between the first end 102 and the second end 104 of the labeling device 100 about the stem 120.

In the example, because the label 113 is opposite the attachment means 130, when the attachment means 130 is connected to the mounting surface 300 the label 113 is facing away from the mounting surface 300. The label 113 is thus visible to an observer looking at the labeling device 100 from the first end 102 when the attachment means 130 is connected to the mounting surface 300.

In other examples, where the attachment means 130 may be different than a magnet, the mounting surface 300 may also be different. For example, in embodiments in which the attachment means 130 includes touch fasteners, the mounting surface 300 may be a corresponding touch fastener. In even further embodiments in which the attachment means 130 includes an adhesive, the mounting surface 300 may also be a metal wall, but could be any surface suitable for the attachment means 130 to adhere to the mounting surface 300 such that the labeling device 100 and/or the spool or bobbin 200 is secured thereto.

In situations where the labeling device 100 is not in use, such as when the spool or bobbin 300 contains a material different than the material indicated on the informational label 113, the labeling device 100 may be itself stored in the same way as when the labeling device has been inserted into the spool or bobbin 200. For example, the labeling device 100 may be attached to the mounting surface 300 absent the spool or bobbin 200 by connecting the attachment means 130 to the mounting surface 300. This may be convenient for a user not only to keep track of the labeling device 100, but also as a marker or tracking means to indicate that resources for the material indicated by the label 113 have been exhausted and/or that the material needs to be replenished.

With continued reference to FIGS. 18-25, a method of using the labeling device 100, and of using the system 10, will now be described. Looking first to FIGS. 18-19, the method may include obtaining the labeling device 100 as described above, and further may include obtaining the spool or bobbin 200 as described above. The labeling device 100 may include the label 113 indicating a material held on and/or by the spool or bobbin 200. In some embodiments in which there are a plurality of labeling devices 100 and/or spools or bobbins 200, the method may also include selecting a labeling device 100 from the plurality of labeling devices 100 which includes the label 113 corresponding to the material held on and/or by the spool or bobbin 200.

In performing the method, a user who has obtained the (correct) labeling device 100 and the spool or bobbin 200 may proceed to insert the labeling device 100 into the spool or bobbin 200. Inserting the labeling device 100 into the spool or bobbin 200 may include inserting the stem 120 of the labeling device 100 into the through-hole 206 of the spool or bobbin 200 in a direction from the first end 102 towards the second end 104. The stem 120 may be inserted through the through-hole 206 from the second opening 209 to the first opening 208, such that the attachment means 130 aligns flush with or extends at least partially through the first opening 208, as shown in FIGS. 20-25.

The method may further include contacting and/or connecting the mounting surface 300 with and/or to the attachment means 130, such that the attachment means 130 is secured to the mounting surface 300, as shown in FIG. 24. When the mounting surface 300 and the attachment means 130 are engaged following the insertion of the labeling device 100 into the spool or bobbin 200 as described above, the spool or bobbin 200 may be held substantially between the first end 102 and the second end 104 of the labeling device 100. A user may choose to leave the spool or bobbin 200 in such a position between the first end 102 and the second end 104 when the labeling device 100 is attached to the mounting surface 300 during storage of the spool or bobbin 300 (e.g., during a storage of the materials held on or by the spool or bobbin 200).

Preferably, the labeling device 100 is oriented such that, when the attachment means 130 engages with the mounting surface 300, the information contained on or conveyed by the label 113 is easily read or understood by the user or another observer. For example, where the label 113 includes text and the labeling device 100 is attached to a vertical wall, the labeling device 100 may be oriented such the text is right-side-up, as shown in FIG. 22.

In some embodiments, the method may further include removing the labeling device 100 from the mounting surface 300, such as by disengaging or unfastening the attachment means 130 from the mounting surface 300. The disengaging of the attachment means 130 from the mounting surface 300 may depend on the type of attachment means 130 present on the labeling device 100. For example, where the attachment means 130 includes a magnet, disengaging of the attachment means 130 from the mounting surface 300 may be as simple as pulling on the spool or bobbin 200 in a direction away from the mounting surface 300 (e.g., in a direction from the second end 104 towards the first end 102) to remove the attachment means 130 from the mounting surface 300.

In even further embodiments, the user may choose to remove the labeling device 100 from the spool or bobbin 200, for example, by pulling the labeling device 100 out and/or away from the spool or bobbin 200 in a direction from the second end 104 towards the first end 102. The method may then be repeated as needed, such as when different labeling devices 100 having an informational label 113 which indicates a different material on the spool or bobbin 200 is to be inserted into the spool or bobbin 200.

The ability to separate the head 110 and the stem 120 from each other in certain embodiments, as described above, provides additional variability for the labeling device 100. For example, the method may include substituting the head 110 of the labeling device with another version of the head 110 (not shown), the only difference between the two being in the information conveyed by the respective informational labels 113. In another embodiment, the different versions of the heads 110 (not shown) may have different sizes, shapes, and/or labels. The substituting of the head 110 of the labeling device may include detaching the head 110 from the stem 120. The detaching of the head 110 from the stem 120 may depend on the type of locking mechanism connecting the head 110 to the stem 120. For example, referring to the embodiment of FIGS. 12-17 (described above) in which the locking mechanism includes the plurality of slots 116 on the head 110 and the corresponding plurality of protrusions 123 on the stem 120, the detaching of the head 110 from the stem 120 may include applying a twisting or rotating motion to the head 110 and/or the stem 120 in the second direction (described above) to disengage the locking mechanism and separate the head 110 from the stem 120. The user may then obtain the appropriate version of the head 110 (conveying the correct information on the label 113 or having the correct size or shape) and engage the slots 116 thereon with the protrusions 123 on the stem 120. The user may then apply a twisting or rotating motion to the head 110 and/or the stem 120 in the first direction (described above) to secure the head 110 and stem 120 together.

The separation and/or attachment of the head 110 and the stem 120, as well as the replacement of the head 110 with another version of the head 110 as described above, may be accomplished regardless of whether the labeling device 100 is inserted into the spool or bobbin 200, and regardless of whether the stem 120 is secured to the mounting surface 300 via the attachment means 130. For example, where the stem 120 is secured to the mounting surface 300 via the attachment means 130, the twisting or rotating motion may be applied to at least the head 110 to detach and/or remove the head 110 from the stem 120 without moving the position of the stem 120 relative to the mounting surface 300. Similarly, where the labeling device 100 has been inserted into the spool or bobbin 200, the spool or bobbin 200 may be substantially around the stem 120, such that the twisting or rotating motion may be applied to at least the head 110 to detach and/or remove the head 110 from the stem 120 without moving the position of the stem 120 relative to the bobbin 200. In either case, or in the case of both the stem 120 being secured to the mounting surface 300 and the spool or bobbin 200 being substantially around the stem 120, the head 110 may also be reattached to the stem 120 without moving the position of the stem 120 relative to either the spool or bobbin 200 or the mounting surface 300.

As noted above, the attachment means 130 may be touch fasteners which are also referred to as hook and loop fasteners, hook and pile fasteners, hook and hoof fasteners, Velcro®, etc. Touch fasteners have a first fastening component and a second fastening component that are configured to detachably and/or removably engage with, couple, connect, and/or attach to each other, for example, a hook component and a loop component, respectively. The hook and loop components are connected to opposing surfaces and/or objects that are to be coupled, attached, and/or fastened together. In one embodiment, one of the hook and loop components may be secured to the stem 120 and the other of the hook and loop components may be secured to the mounting surface 300. For example, when hook and loop components are pressed together, a densely packed plurality of small hooks catches in a densely packed plurality of small loops, fastening the hook and loop components (and the surfaces and/or objects coupled thereto, respectively) together. Other touch fasteners include, for example, systems that have double hooks for use with loops, or systems that have interlocking, opposably facing mushroom shaped connectors (e.g., Dual Lock® by 3M®), mushrooms and loops, and hooks and hooks that engage with each other. A feature of touch fasteners is that the objects and/or surfaces may be fastened and separated or unfastened (i.e., detachably and/or removably coupled and/or engaged), with the touch fasteners being reusable (i.e., the objects/surfaces may be recoupled and/or reengaged with the same touch fasteners). The term "touch fastener(s)" (and the equivalents thereof) are used herein to refer generally to any of the above forms and/or systems of touch fasteners, all of which may be interchangeably applied in combination with other aspects disclosed herein to achieve the present disclosure.

In embodiments disclosed herein, various components utilize touch/hook and loop fasteners and/or constructs for fastening (e.g., detachably and/or removably coupling, attaching, and/or engaging). The touch/hook and loop fasteners may comprise a hook component and a loop component. In some such embodiments, the hook component may be formed from a plastic material, a woven fabric material, or a combination of plastic and woven fabric materials. In some embodiments, the loop component may be formed from a plastic material, a woven fabric material, a non-woven fabric material, or velour. In some embodiments, the hook or loop portions of the touch fastener(s) have a base that is, for example, a fabric and/or plastic material. In accordance with aspects of the disclosure, other materials may be used in the base. The base is generally a flexible or bendable material. The back sides of the hook and/or loop that are opposite the operable hook and/or loop include, for example, an adhesive, a solvent, or a heat sensitive material for attaching, fastening, and/or coupling to the opposing surfaces to be connected. In some embodiments, sides of the hook and/or loop that are opposite the operable hook and/or loop include a pressure sensitive adhesive or a heat activated adhesive for attaching, fastening, and/or coupling to a surface and/or object. Other backing adhesion materials on the back side of the bases include, for example, a heat welding compound, or a solvent.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a storage container that "comprises," "has," "includes," or "contains" one or more elements possesses those one or more elements, but is not limited to possessing only those one or more elements. Likewise, where an element "comprises," "has," "includes," or "contains" one or more features, that element possesses those one or more features, but is not limited to possessing only those one or more features. Furthermore, a structure that is configured in a certain way is configured in at least that way, but may also be configured in ways that are not listed.

The disclosure herein has been described with reference to the preferred embodiments. It will be understood that the architectural and operational embodiments described herein are exemplary of a plurality of possible arrangements to provide the same general features, characteristics, and general system operation. Modifications and alterations will occur to others skilled in the art upon a reading and understanding of the preceding detailed description to accomplish the same objectives. Accordingly, it is intended that the disclosure, including the appended claims, be construed as including all such alternative aspects, modifications and alterations as fall within the true spirit and scope of the disclosure.

What is claimed is:

1. A bobbin insert, comprising:

a head;

a stem extending from the head; and an attachment member connected to the stem;

wherein the stem is removably attached to the head via a locking mechanism.

2. The bobbin insert of claim 1, wherein the head further comprises an informational label.

3. The bobbin insert of claim 2, wherein the head further comprises:

a first face; and a second face;

wherein the stem extends from the first face, and wherein the second face includes the informational label.

4. The bobbin insert of claim 1, wherein the stem further comprises:

a first end; and a second end;

wherein the first end couples to the head, wherein the second end includes a cavity, and wherein the attachment member is located at least partially in the cavity.

5. The bobbin insert of claim 1, wherein the locking mechanism comprises:

a plurality of protrusions on an end of the stem; and a plurality of slots on a face of the head; and wherein each protrusion of the plurality of protrusions is insertable into a slot of the plurality of slots, and wherein, after the plurality of protrusions are inserted into the plurality of slots, a twisting of at least one of the stem or the head secures the stem to the head.

6. The bobbin insert of claim 1, wherein the stem and the head are integral.

7. The bobbin insert of claim 1, wherein the attachment member is coupled to the stem, and wherein the attachment member further comprises:

one of a magnet, an adhesive strip, and a touch fastener.

8. A system for storing or labeling a bobbin, comprising:
a bobbin, the bobbin comprising:
a first opening on a first end of the bobbin;
a second opening on a second end of the bobbin, wherein the second end is opposite the first end; and
a through-hole extending from the first opening to the second opening; and
an insert, the insert comprising:
a head;
a stem extending from the head; and
an attachment member connected to the stem;
wherein the stem of the insert is configured to be inserted into the through-hole of the bobbin through the first opening and at least a portion of the attachment member is configured to extend out of the second opening.

9. The system of claim 8, further comprising an exterior surface, and wherein the attachment member is configured to engage with the exterior surface to secure the insert to the exterior surface.

10. The system of claim 9, wherein the attachment member is engaged with the surface and the bobbin is located substantially between the head and the surface.

11. The system of claim 8, wherein the head further comprises:
a first face; and
a second face;
wherein the stem extends from the first face, and wherein the second face includes an informational label.

12. The system of claim 8, wherein the stem further comprises:
a first end; and
a second end;
wherein the first end is configured for connection to the head, and wherein the second end includes a cavity and is configured to receive at least a portion of the attachment member.

13. The system of claim 8, wherein the stem is configured to be removably attached to the head via a locking mechanism, the locking mechanism comprising:
a plurality of protrusions on an end of the stem; and
a plurality of slots on a face of the head;
wherein each protrusion of the plurality of protrusions is configured to be removably inserted into a slot of the plurality of slots, and wherein, after the plurality of protrusions are inserted into the plurality of slots, a twisting of at least one of the stem or the head secures the stem to the head.

14. The system of claim 8, the system further comprising:
a plurality of heads; and
a plurality of informational labels, each informational label of the plurality of informational labels indicating a potential material held by the bobbin; and
wherein each head of the plurality of heads includes at least one informational label of the plurality of informational labels.

15. The system of claim 8, wherein the attachment member further comprises:
one of a magnet, an adhesive strip, and a touch fastener.

16. A method for storing or labeling a bobbin, comprising:
obtaining a bobbin, the bobbin comprising:
a first opening on a first end of the bobbin;
a second opening on a second end of the bobbin, the second end opposite the first end; and
a through-hole extending from the first opening to the second opening; and
obtaining an insert, the insert comprising:
a head;
a stem extending from the head; and
an attachment member connected to the stem; and
inserting the stem of the insert into the through-hole through the first opening, such that at least a portion of the attachment member is level with or extends through the second opening.

17. The method of claim 16, further comprising contacting an exterior surface with the attachment member to secure the insert to the exterior surface via the attachment member.

18. The method of claim 16, further comprising connecting the attachment member to the stem, wherein the stem includes a cavity configured to receive the attachment member, and wherein the attachment member is received in the cavity.

19. The method of claim 16, wherein the obtaining the insert further comprises selecting the head of the insert, the head including an informational label which corresponds to a material which is held by the bobbin.

* * * * *